United States Patent [19]

Endo

[11] 4,448,280

[45] May 15, 1984

[54] CARBURETOR

[75] Inventor: Haruo Endo, Matsuda, Japan

[73] Assignee: Mikuni Kogyo Kabushiki Kaisha, Tokyo, Japan

[21] Appl. No.: 318,197

[22] Filed: Nov. 4, 1981

[30] Foreign Application Priority Data

Dec. 7, 1980 [JP] Japan ..... 55-175118[U]

[51] Int. Cl.[3] ..... B01H 13/36

[52] U.S. Cl. ..... 181/229

[58] Field of Search ..... 181/229, 243, 272, 247, 181/248, 249, 250, 251

[56] References Cited

U.S. PATENT DOCUMENTS

Re. 30,306 6/1980 Moore et al. ..... 181/229

2,681,120 6/1954 Sebok ..... 181/229

*Primary Examiner*—Donald A. Griffin

*Assistant Examiner*—Brian W. Brown

*Attorney, Agent, or Firm*—Cushman, Darby & Cushman

[57] ABSTRACT

A carburetor for internal combustion engines wherein air to be introduced into an air jet is taken in directly from a part of a suction silencer in order to prevent an air-fuel mixture to be fed to an engine from becoming too rich when the air jet is clogged with a snow powder.

3 Claims, 2 Drawing Figures

CARBURETOR

BACKGROUND OF THE INVENTION (a) Field of the Invention

This invention relates to carburetors for internal combustion engines and more particularly to improvements in a carburetor formed so as to be adaptable to be used for snow mobiles and the like.

(b) Description of the Prior Art

In a presently used carburetor for internal combustion engines, generally main air and pilot air are to be taken in from a choke bore. Therefore, in a snow mobile or snow running car, an air jet chamber will be filled with a snow powder to clog the air jet to make an air-fuel mixture fed to an engine so rich as to often stop or trouble the engine.

SUMMARY OF THE INVENTION

In order to eliminate such defect, the present invention is to provide a carburetor wherein air to be introduced into an air jet is not taken in from within a choke bore but can be taken in directly from a part of a suction silencer, that is, a part in which no snow will flow or accumulate.

Another object of the present invention is to provide a carburetor formed so as to be able to be used as the same conventional carburetor by only removing an accessory part.

DESCRIPTION OF THE PREFERRED EMBODIMENT

Figure 1:
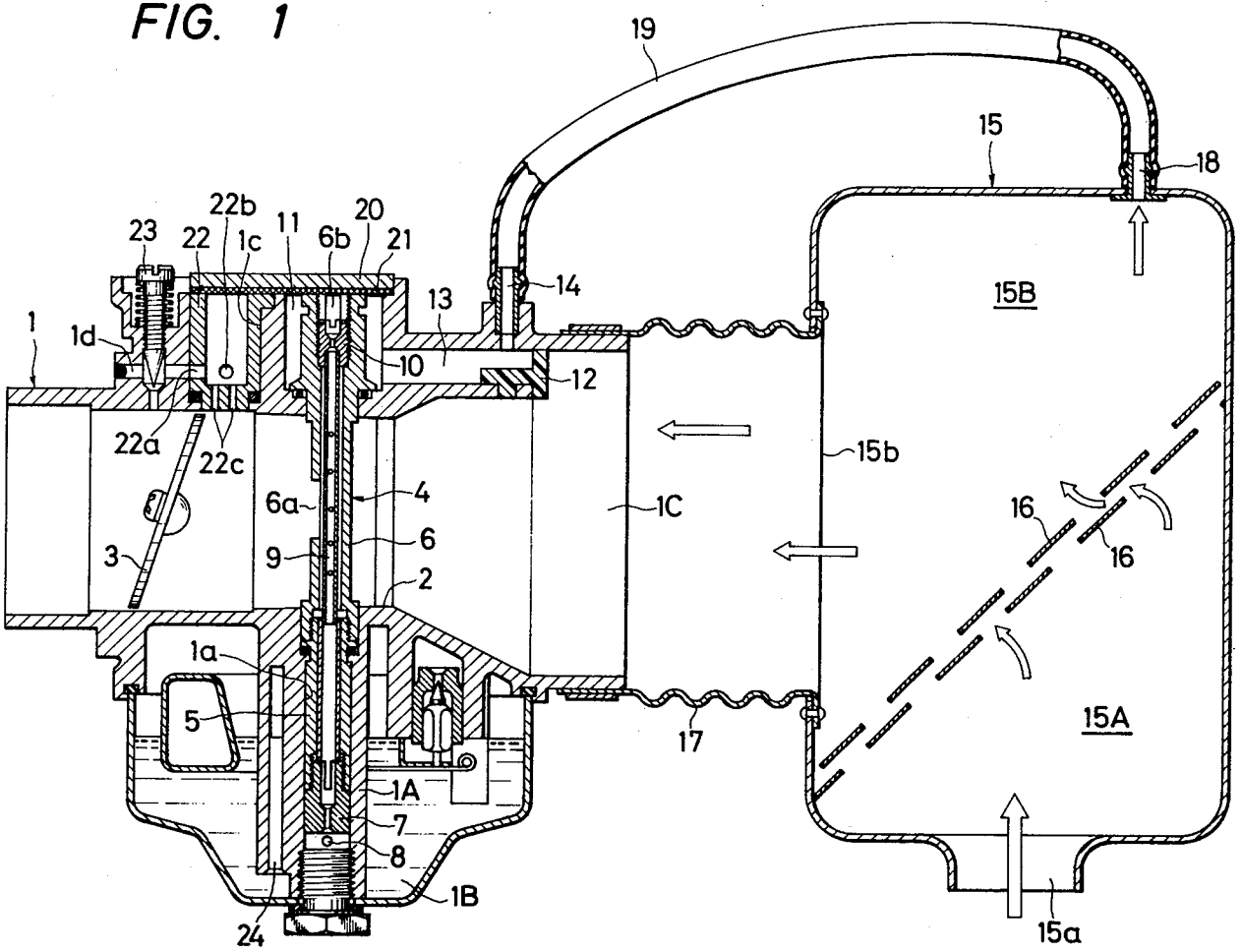
FIG. 1 is a vertically sectioned view showing an embodiment of a carburetor according to the present invention.
Figure 2:
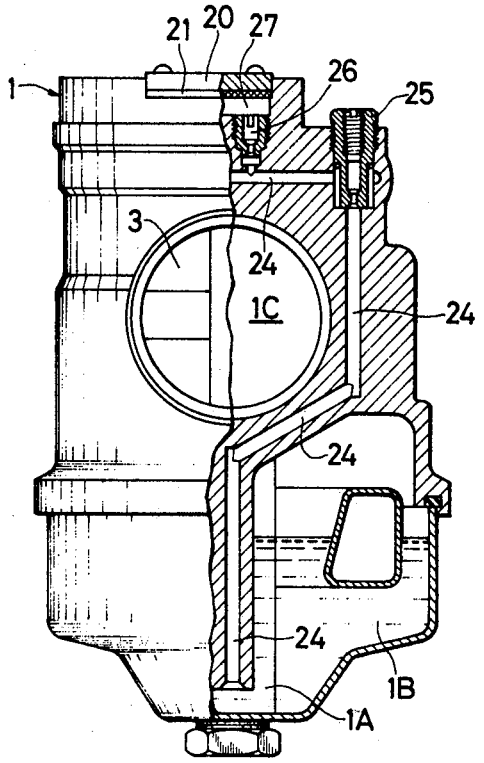
FIG. 2 is a left side view of FIG. 1 shown as partly sectioned.

In FIGS. 1 and 2, the reference numeral 1 denotes a carburetor body, 2 denotes a venturi, 3 denotes a butterfly throttle valve, 4 denotes a main nozzle assembly including a tubular jet holder 5 air-tightly fitted within a through hole 1*a* extending vertically through a boss part 1A and a nozzle tube 6 inserted air-tightly through a hole 1*b* made in the upper part of the carburetor body 1 coaxially with the through hole 1*a* and screwed at the lower end to the upper end of the jet holder 5 within the through hole 1*a*, 7 denotes a main jet screwed to the lower end of the jet holder 5, 8 denotes a hole made in the side wall of the boss part 1A to make the inlet of the main jet 7 communicate with a float chamber 1B, 9 denotes a bleed pipe, 10 denotes a main air jet screwed in from the upper opening end of the nozzle pipe 6, 11 denotes an annular air chamber formed between the inner wall surface of the large diameter part of the hole 1*b* and the outer peripheral surface of the head part of the nozzle tube 6 and made to communicate with the main air jet 10 through a split groove 6*b* formed in the diametral direction in the top part of the nozzle tube 6, 12 denotes a plug body removably fitted in the inlet of an air introducing path 13, able to interrupt the communication of the air introducing path with the suction bore 1*c* and made of rubber or the like, 14 denotes a nipple fitted to the carburetor body, 15 denotes a suction silencer sectioned within with a plurality of silencing plates 16 into a first chamber 15A having an air inlet 15*a* and a second chamber 15B having an air outlet 15*b* of substantially the same diameter as of the suction bore 1*c*, 17 denotes a bellows tube connecting the air outlet 15*b* of the suction silencer 15 with the suction bore 1C and substantially serving as a member for supporting the suction silencer 15 on the carburetor body 1, 18 denotes a nipple fitted to the side wall on the second chamber 15B side of the suction silencer 15, 19 denotes a pipe fitted at the respective ends to the nipples 14 and 18 to make the air introducing path 13 communicate with the second chamber 15B of the suction silencer 15, 20 denotes a cover plate fitted to the carburetor body 1 through a gasket 21 and pressing downward the top surface of the main assembly 4 to keep the air-tightness between the jet holder 5 and through hole 1*a* and between the nozzle tube 6 and hole 1*b* and to close the upper opening of the air chamber 11, 22 denotes a cylindrical jet block air-tightly fitted within the hole 1C formed in the upper part of the carburetor body 1 adjacently to the air chamber 11 and having through holes 22*a* and 22*b* formed in the side wall and through holes 22*c* formed in the bottom wall and communicating with the suction bore 1C, 23 denotes an idling screw screwed to the carburetor body 1 and able to adjust the flow volume of the fuel flowing through a path 1*d* communicating with the through hole 22*a*, 24 (See FIG. 2) denotes a fuel path opened at one end within the float chamber 1B and connected at the other end to the through hole 22*b* of the jet block 22, 25 denotes a pilot jet screwed from above into the carburetor body 1 in the course of the fuel path 24, and 26 denotes a pilot air jet which is screwed from above into the carburetor body 1 and is on the inlet side covered with the cover plate 20 through the gasket 21 and opened within an air chamber 27 communicating with the above mentioned air chamber 11 and on the outlet side opened within the fuel path 24. By the way, the upper opening of the jet block 22 is closed with the cover plate 20 through the gasket 21 in the same manner as of the air chamber 11, the main nozzle assembly 4 forms a main fuel feeding system and the fuel path 24, pilot jet 25, pilot air jet 26 and jet block 22 form a low speed fuel system.

The operation of the carburetor according to the present invention shall be explained in the following. It is as well known that, at the time of starting and idling the engine, an air-fuel mixture will be fed to the engine mostly through the path 1*d* and through holes 22*c* through the low speed fuel system and, in response to the opening of the throttle valve, a proper amount of the mixture obtained of the fuel sucked in through the main jet 7 and air sucked in through the main air jet 10 will be jetted out of the nozzle 6*a* of the nozzle tube 6 so as to be fed to the engine. However, in such case, air to be fed to the main air jet 10 and pilot air jet 26, that is, to be introduced into the air chambers 11 and 27 will be taken in directly from the second chamber 15A of the suction silencer 15, that is, from the part in which no snow will flow or accumulate even when used while snow is falling through the nipple 18, pipe 19, nipple 14 and air introducing path 13. Therefore, even a snow powder will not flow into the air chambers as in the conventional structure of this kind. Thus the air jets 10 and 26 will not be clogged and the engine will be able to always continue a favorable operation. By the way, according to the present invention, as the plug body 12 for interrupting the communication of the air introducing path 13 with the suction bore 1C is removable, in such case that a well known air cleaner is to be fitted to be used in place of the suction silencer 15 in a place having no snow, by removing the plug body 12 and fitting a plug into the nipple 14, the carburetor can be used in the same manner as of the conventional structure and the range of utilizing the carburetor can be made wider.

As described above, according to the present invention, there can be provided carburetors which can always develop a sufficient performance even when used while snow is falling and which can be used favorably for snow running cars and snow mobiles.

I claim:

1. A carburetor for internal combustion engines comprising a suction bore, an air introducing path having an air inlet opening within said suction bore, an air chamber made to communicate with said air introducing path, a main air jet and pilot air jet opening within said air chamber, a plug body fitted in said air inlet so as to interrupt the communication of the air introducing path with said suction bore, a suction silencer connected to said suction bore so as to introduce air into said suction bore and sectioned into a first chamber and second chamber with a plurality of silencing plates fitted within and means for making the second chamber communicate with said air introducing path, said first chamber having an air inlet.

2. A carburetor according to claim 1 wherein said plug body is removable from said air inlet.

3. A carburetor according to claim 1 wherein said air introducing path is made to communicate with the part of the lowest velocity of air flowing within said second chamber.

* * * * *